US005356053A

United States Patent [19]

Di Fatta

[11] Patent Number: 5,356,053

[45] Date of Patent: Oct. 18, 1994

[54] FUNNEL-LESS SQUEEZE CAP

[76] Inventor: Joseph Di Fatta, 1230 Scarlet Dr., Addison, Ill. 60101

[21] Appl. No.: 985,643

[22] Filed: Dec. 7, 1992

[51] Int. Cl.[5] ..... G01F 11/26

[52] U.S. Cl. ..... 222/456; 222/207; 222/454; 222/478

[58] Field of Search ..... 222/207, 454, 456, 478, 222/571

[56] References Cited

U.S. PATENT DOCUMENTS

| | | | |
|---|---|---|---|
| 570,759 | 11/1896 | Law | 222/456 |
| 2,783,923 | 3/1957 | Croce | 222/478 X |
| 3,221,951 | 12/1965 | Souza | 222/456 |
| 4,318,500 | 3/1982 | Melikian | 222/454 X |
| 4,597,513 | 7/1986 | Schiemann | 222/478 |
| 4,613,064 | 9/1986 | Meyer et al. | 222/456 |
| 4,838,464 | 6/1989 | Briggs | 222/478 |
| 4,893,732 | 1/1990 | Jennings | 222/456 X |

FOREIGN PATENT DOCUMENTS

| | | | |
|---|---|---|---|
| 2095637 | 10/1982 | United Kingdom | 222/478 |

*Primary Examiner*—Andres Kashnikow
*Assistant Examiner*—Joseph A. Kaufman
*Attorney, Agent, or Firm*—Charles F. Meroni, Jr.

[57] ABSTRACT

The Funnel-less Squeeze Cap is designed to control the flow of a liquid or semi solid substance. The angle of the hollow chamber of the cap inhibits or allows the flow of a substance depending upon the position of the container. When the container is rotated counter-clockwise, the substance flows; when the container is rotated clockwise, the substance stops; when the container is vertical, the substance is level and will not drip. Controlling the flow allows the container to be used without a funnel and the flow can be directed.

10 Claims, 4 Drawing Sheets

FUNNEL-LESS SQUEEZE CAP

SUMMARY OF THE INVENTION

The object of this invention is to allow a container filled with a liquid or semi-solid substance to pour the substance without a funnel or to control the flow of the substance by squeezing the container.

BRIEF DESCRIPTION OF DRAWINGS (all cross-sectional views)

FIG. 1: Free standing Funnel-less Squeeze Cap.

FIG. 2: Funnel-less Squeeze Cap attached to container.

FIG. 3: Container with cap; inverted ready to use.

FIG. 4: Container with cap; tilted counter-clockwise to pour substance.

FIG. 5: Container with cap; tilted clockwise to stop flow.

FIG. 6: Funnel-less Squeeze Cap and container in one unit.

FIG. 7: Unit inverted-ready to use.

FIG. 8: Unit tilted counter-clockwise to pour substance.

FIG. 9: Sliced aerial view of opening to unit.

FIG. 10: Unit tilted clockwise to stop the flow.

FIG. 11: Free standing Funnel-less Squeeze Cap with narrow neck opening.

FIG. 12: Narrow Funnel-less Squeeze Cap attached to container.

FIG. 13: Narrow Funnel-less Squeeze Cap inverted ready to use.

FIG. 14: Narrow Funnel-less Squeeze Cap with pressure applied to sides of container to force flow.

FIG. 15: Narrow Funnel-less Squeeze Cap and container in one unit; inverted-ready to use.

FIG. 16: Unit with pressure applied to sides of container to force flow.

DETAILED DESCRIPTION OF INVENTION

Figure 1:
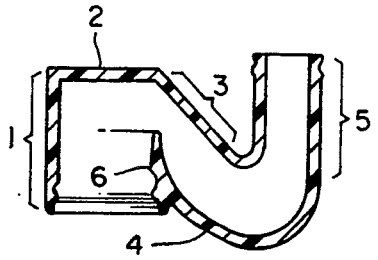

The Funnel-less Squeeze Cap is designed to control the flow of a liquid or semi-solid substance. The cap is made out of a solid substance, preferably plastic, with a hollow 8-shaped center. FIG. 1. The internal structure of the cap is as follows: the hollow chamber begins straight upward (1); and extends sideways at a ninety degree angle (2); and extends downward at approximately a forty five degree angle (3); and extends sideways (4); parallel to (2); or extends straight upward (5); parallel to (1). The angle in the middle of the chamber inhibits or allows the flow of the substance depending upon the position of the container with the cap on it.

Figure 3:
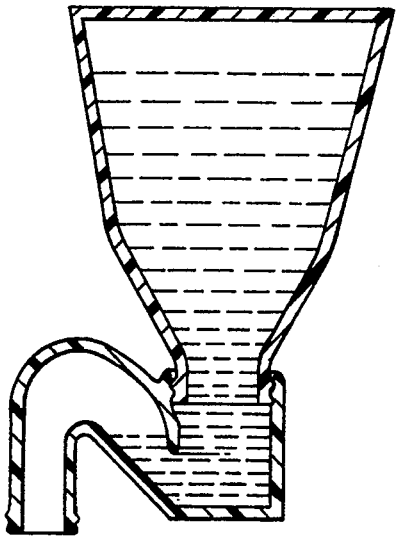
Figure 5:
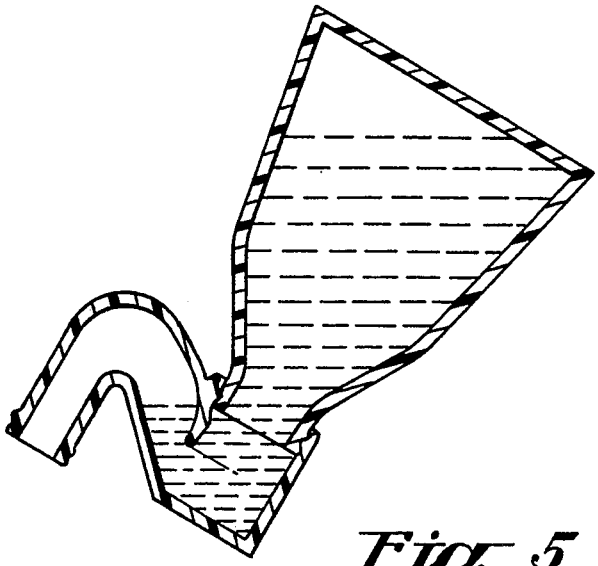
Figure 4:
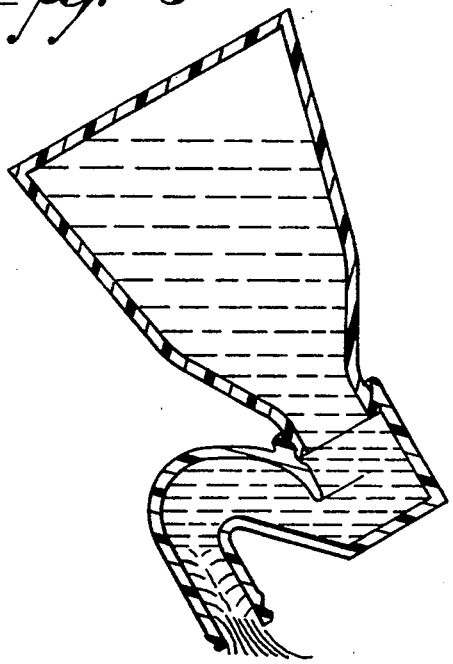
Figure 7:
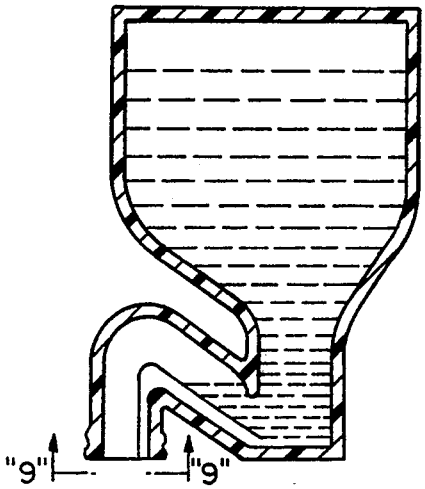
Figure 8:
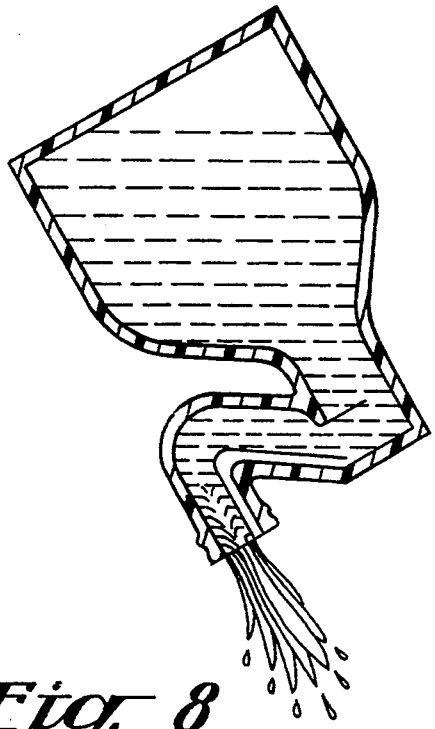
Figure 10:
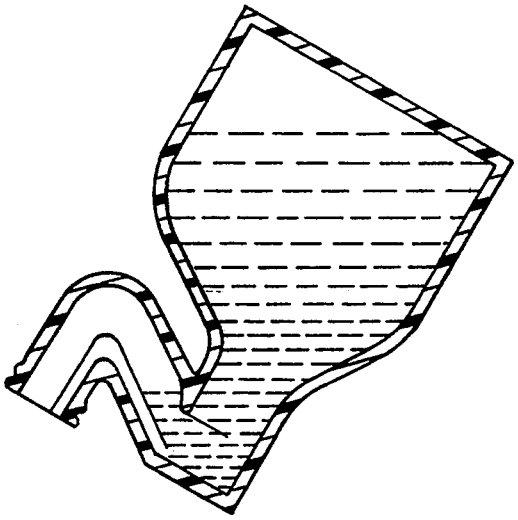

With the angle in the middle of the chamber, pointed toward the northwest quarter, the substance will flow with the angle of the middle chamber and pour out of the opening when the unit is tilted counter-clockwise at approximately a thirty degree angle. FIG. 4 and 8. When the unit is tilted clockwise, the substance will flow against the angle of the middle chamber and the flow will be stopped. FIG. 5 and 10. When the unit is vertical, the existence of the angle in the middle chamber forces the substance to level off and inhibits the substance from entering the last extension of the cap. This position prohibits drips or spill from the opening of the unit. FIG. 3 and 7.

Figure 2:
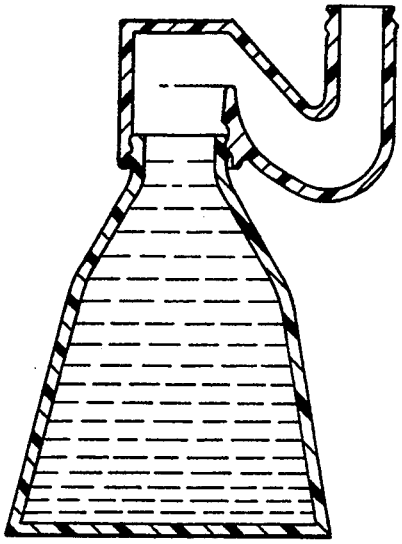
Figure 11:
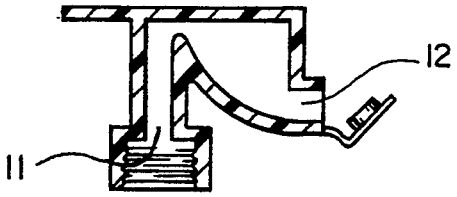

The Funnel-less Squeeze Cap can be made as a free standing device. FIG. 1 and 11. Standard threads are made on the inside wall of the chamber (6). FIG. 1. This allows the cap to be placed on separate containers. FIG. 2 end 12. Removal of the cap would allow the original container to be refilled.

A common use for the Funnel-less Squeeze Cap is car fluids such as oil. Use of either the free standing cap or the one piece unit would eliminate the need for a funnel.

Figure 6:
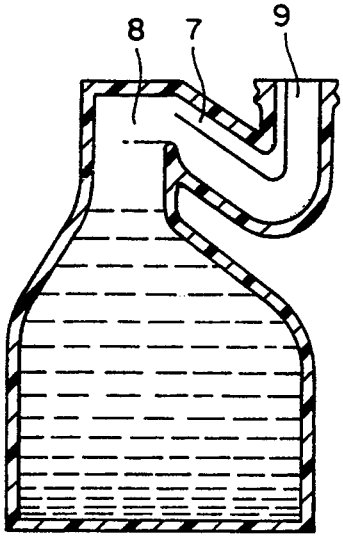
Figure 9:
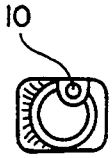
Figure 13:
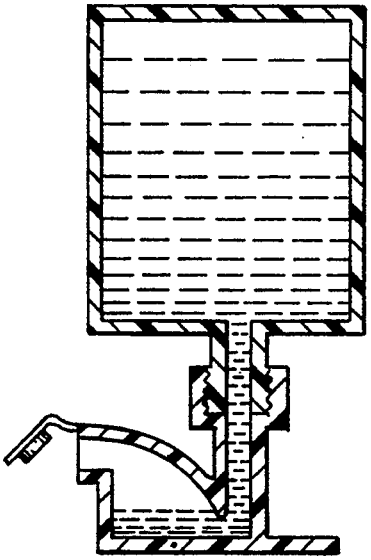
Figure 14:
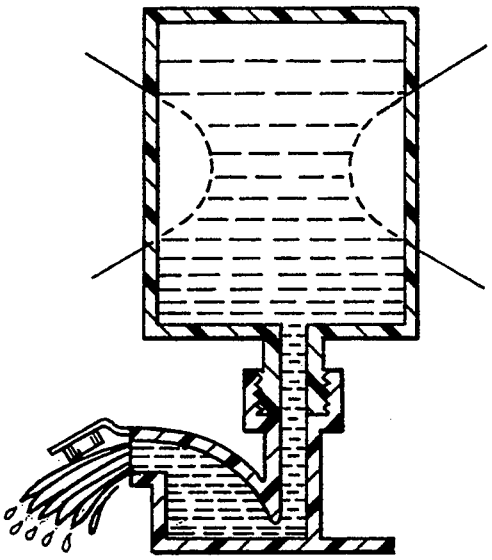
Figure 15:
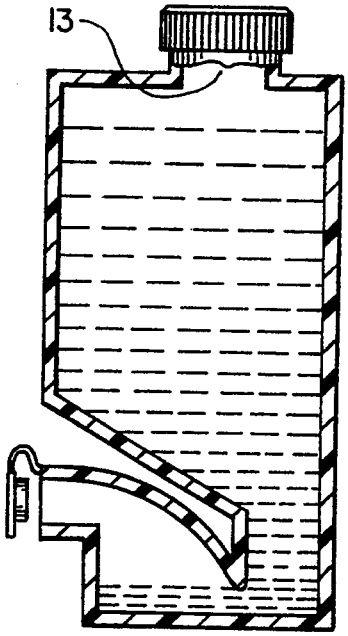
Figure 16:
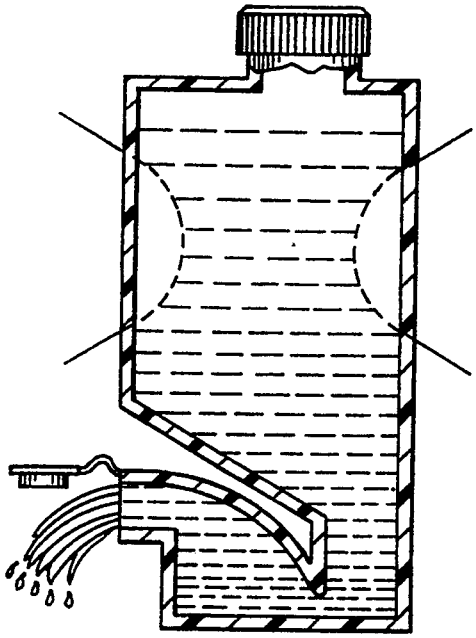

The Funnel-less Squeeze Cap can be made as part and parcel of the container. This would create a single unit. FIG. 6 and 15. The container has a holding chamber, which is the inner portion of the container that holds the substance. This holding chamber communicates with the container opening. An air passage must exist if the container and the cap are a single unit. The air passage could be built into the chamber of the cap (7). FIG. 6. Or, an air passage could be created by an additional opening in the unit (13). FIG. 15. If the air passage is built in, it would begin at the middle of the chamber (8) and extend through the opening (9). FIG. 6. The air passage is hollow (7). FIG. 6. The air passage is separate from the main chamber of the cap (10). FIG. 9. If the air passage is created by an additional opening(s), that opening(s) must be sealed when the unit is filled in order to trap the air. FIG. 15. An end cap may be connected to an outlet opening of the cap. FIGS. 11–16. An end cap may also be connected to seal the air passage(s) or container opening(s), except for that air passage or container opening which is utilized to flowingly connect the cap to the container. FIGS. 15 and 16.

By narrowing the beginning of the cap chamber (11) the substance is more easily controlled. FIG. 11. Condensing the interior of the container by squeezing the sides puts greater force against the substance as it pours through the narrower opening. FIG. 14 and 16. Also, by narrowing the ending of the cap chamber (12) the substance is more easily directed. FIG. 11.

A common use for the narrow Funnel-less Squeeze Cap is household cleaners such as toilet bowl cleaners; or beauty products such as shampoos, conditioners; or condiments such as ketchup, mustard.

Figure 12:
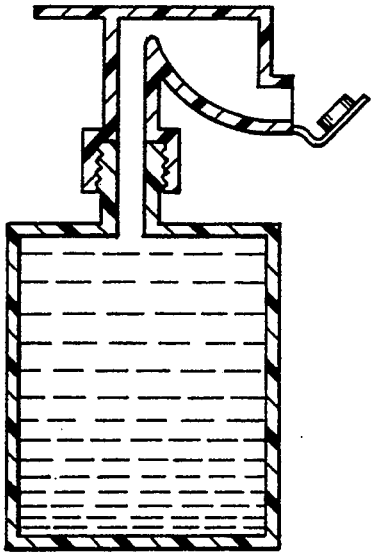

If the unit is constructed with the Funnel-less Squeeze Cap on the top, the substance will settle toward the bottom. FIG. 2, 6 and 12. To utilize the cap, the container must be inverted to allow the substance to pass through the chamber in the cap. FIG. 3, 7 and 13.

What is claimed is:

1. An invertible cap for controlling the flow of a substance, comprising:

a housing having a horizontal flat base for allowing the cap to be able to rest on the horizontal flat base in an inverted position, the housing further having a hollow S-shaped chamber, the S-shaped chamber having a first end portion communicating with an inlet opening of the housing, and a second end portion of the S-shaped chamber communicating with an outlet opening of the housing, so that the substance is contained in the housing towards the first end portion of the S-shaped chamber when the cap is in the inverted position and is continuously dispensed through the second end portion of the S-shaped chamber when the cap is tilted about a 30° angle from the inverted position; and means for flowingly connecting the housing a horizontal flat bottomed container.

2. The cap of claim 1 wherein the housing and the container are a single unit with the inlet opening of the housing communicating to a holding chamber of the container and the housing further having an air passage, the air passage is operatively connected to the housing within the hollow S-shaped chamber.

3. The cap of claim 1 wherein the housing and the container are a single unit having an additional outlet opening, the additional outlet opening functioning as a passage for air.

4. The cap of claim 3, further comprising, an end cap and means for connecting the end cap to the additional outlet opening.

5. The cap of claim 1, further comprising, and end cap and means for connecting the end cap to the outlet opening.

6. In combination, a container with a container opening, and an invertible cap for controlling the flow of a substance connected to the container, the cap having an inlet opening and outlet opening, comprising:

(a) the cap having a horizontal flat base for allowing the cap to be able to rest on the horizontal flat base in an inverted position, the cap further having a hollow S-shaped chamber, the S-shaped chamber having a first end portion communicating with the inlet opening of the cap, and a second end portion of the S-shaped chamber communicating with the outlet opening of the cap, so that the substance is contained in the housing towards the first end portion of the S-shaped chamber when the cap is in the inverted position and is continuously dispensed through the second end portion of the S-shaped chamber when the cap is tilted about a 30° angle from the inverted position;

(b) the container having a horizontal flat bottom portion parallel to the horizontal flat base for allowing the container to be able to rest on the horizontal flat bottom portion in a non-operational position, and the container having a holding chamber communicating with the container opening; and (c) means for flowingly connecting the cap to the container.

7. The combination of claim 6, further comprising, the cap having an air passage, the air passage being operatively connected to the cap within the S-shaped chamber.

8. The combination of claim 6, further comprising, an additional container opening operatively connected to the container.

9. The combination of claim 8, further comprising, an end cap and means for connecting the end cap to the additional container opening.

10. The combination of claim 6, further comprising, an end cap and means for connecting the end cap to the outlet opening.

* * * * *